US012169074B2

(12) United States Patent
Fukuda

(10) Patent No.: US 12,169,074 B2
(45) Date of Patent: Dec. 17, 2024

(54) HEAT-PUMP SYSTEM, INDICATOR, USAGE-SIDE UNIT, AND INFORMATION OUTPUT METHOD

(71) Applicants: DAIKIN INDUSTRIES, LTD., Osaka (JP); DAIKIN EUROPE N.V., Oostend (BE)

(72) Inventor: Kazuya Fukuda, Oostend (BE)

(73) Assignees: Daikin Industries, Ltd., Osaka (JP); DAIKIN EUROPE N.V., Ostend (BE)

( * ) Notice: Subject to any disclaimer, the term of this patent is extended or adjusted under 35 U.S.C. 154(b) by 85 days.

(21) Appl. No.: 17/794,515

(22) PCT Filed: Jan. 6, 2021

(86) PCT No.: PCT/JP2021/000139
§ 371 (c)(1),
(2) Date: Jul. 21, 2022

(87) PCT Pub. No.: WO2021/157267
PCT Pub. Date: Aug. 12, 2021

(65) Prior Publication Data

US 2023/0134009 A1 May 4, 2023

(30) Foreign Application Priority Data

Feb. 5, 2020 (EP) ..... 20155631

(51) Int. Cl.
*F24F 11/36* (2018.01)
*F24F 11/38* (2018.01)
*F24F 11/526* (2018.01)

(52) U.S. Cl.
CPC ..... *F24F 11/36* (2018.01); *F24F 11/38* (2018.01); *F24F 11/526* (2018.01)

(58) Field of Classification Search
CPC ..... F24F 11/36; F24F 11/38; F24F 11/526
See application file for complete search history.

(56) References Cited

U.S. PATENT DOCUMENTS 10,650,781 B2 * 5/2020 Lee ..... H05B 47/175
10,852,018 B1 * 12/2020 Floro ..... F24F 11/65
(Continued)

FOREIGN PATENT DOCUMENTS

EP 3 521 717 A1 8/2019
JP 2012-13329 A 1/2012
(Continued)

OTHER PUBLICATIONS

International Search Report of corresponding PCT Application No. PCT/JP2021/000139 dated Mar. 25, 2021.
(Continued)

*Primary Examiner* — Nelson J Nieves
(74) *Attorney, Agent, or Firm* — Global IP Counselors, LLP

(57) ABSTRACT

An indicator outputs information relating to a heat-pump system including a plurality of usage-side units which form a communication network. The indicator includes a mode management section configured to accept selection from a plurality of operation modes of the indicator including a first mode, a unit-side communication section configured to receive or acquire first and second unit signals from a predetermined usage-side unit of the usage-side units, and an indicator output section. The first unit signal is used for information originated by the predetermined usage-side unit. The second unit signal is used for information not originated by the predetermined usage-side unit. The indicator output section is configured to, when alarm information has been received or acquired via a second unit signal while the indicator is operating in a first mode, output the alarm information.

10 Claims, 10 Drawing Sheets

(56) References Cited

U.S. PATENT DOCUMENTS

| | | | | |
|---|---|---|---|---|
| 2014/0137583 | A1* | 5/2014 | Kim | F25B 49/00 62/126 |
| 2018/0135878 | A1* | 5/2018 | Iura | F24F 11/65 |
| 2019/0033807 | A1* | 1/2019 | Inoue | G08C 19/00 |
| 2019/0041080 | A1* | 2/2019 | Higuchi | H04W 4/70 |
| 2019/0162435 | A1* | 5/2019 | Mori | F24F 11/30 |
| 2019/0353392 | A1* | 11/2019 | Atchison | G01K 15/007 |
| 2019/0383511 | A1* | 12/2019 | Tomita | F24F 11/36 |
| 2020/0033021 | A1* | 1/2020 | Ino | F24F 11/54 |
| 2020/0233440 | A1* | 7/2020 | Gillette | F24F 11/76 |
| 2020/0284463 | A1* | 9/2020 | Atchison | F24F 11/79 |
| 2020/0393157 | A1* | 12/2020 | Turney | F24F 11/46 |
| 2021/0018204 | A1* | 1/2021 | Burroughs | F24F 11/47 |
| 2021/0199360 | A1* | 7/2021 | Watanabe | F24F 11/36 |
| 2022/0333793 | A1* | 10/2022 | Kotake | F24F 11/30 |

FOREIGN PATENT DOCUMENTS

| | | | | |
|---|---|---|---|---|
| JP | 2017-53509 | A | 3/2017 | |
| JP | 2017-146065 | A | 8/2017 | |
| WO | WO-2017141774 | A1 * | 8/2017 | F24F 11/30 |

OTHER PUBLICATIONS

European Search Report of corresponding EP Application No. 20 155 631.3 dated Jun. 22, 2020.

International Preliminary Report of corresponding PCT Application No. PCT/JP2021/000139 dated Aug. 18, 2022.

* cited by examiner

464

| | | First mode | Second mode | Third mode |
|---|---|---|---|---|
| First unit signal | Alarm information | Output information | | |
| | Non-alarm information | | | Perform corresponding operation |
| Second unit signal | Alarm information | Output information | Disregard information | |
| | Non-alarm information | | | |

HEAT-PUMP SYSTEM, INDICATOR, USAGE-SIDE UNIT, AND INFORMATION OUTPUT METHOD

TECHNICAL FIELD

The present invention relates to a heat-pump system comprising a plurality of usage-side units and a plurality of indicators.

BACKGROUND ART

JP 2017 053509 A proposes a heat-pump system comprising a plurality of usage-side units and a plurality of indicators for outputting information relating to the heat-pump system. The indicators are connected to the usage-side units, respectively. Each usage-side unit is configured to send alarm information to the connecting indicator when a refrigerant leakage has occurred. Each indicator is configured to, when it has received the alarm information from the connecting usage-side unit, output the alarm information on its display. Thereby, it is possible to inform a user of each usage-side unit of the occurrence of the refrigerant leakage.

Meanwhile, there are cases in which alarm information of any of the usage-side units is desired to be outputted in one location. For example, in a monitoring room of a hotel, it is necessary for a monitoring person to promptly discern alarm information of any of air-conditioning units installed in different guest rooms. However, it is costly and burdensome to connect an information output device in the monitoring room to each of the air-conditioning units disposed in separate locations in order to obtain information therefrom.

Thus, as also proposed by JP 2017 053509 A, the usage-side units may form a communication network, and the information output device may be connected to this network via one of the usage-side units. Information originating from any of the usage-side units is transmitted in the network by means of communication signals, and then transferred to the information output device via one of the usage-side unit. Thereby, it is possible to allow the information output device to obtain information from each of the usage-side units without individual connections. Hence, the alarm information can be outputted from not only the indicator connected to the usage-side unit with an abnormality but also the information output device.

However, providing the information output device which has a configuration different from the indicators would also increase the system cost. Moreover, when the location in which all the alarm information should be outputted needs to be changed, moving and re-connecting the information output device would be burdensome.

CITATION LIST

Patent Literature

[PTL 1] JP 2017 053509 A

SUMMARY OF INVENTION

The object of the present invention is to provide a heat-pump system with high manageability and high usability at a low cost.

A first aspect of the present invention provides a heat-pump system comprising a plurality of usage-side units and a plurality of indicators for outputting information relating to the heat-pump system, wherein: each usage-side unit has an indicator-side communication section configured to transmit first and second unit signals to a predetermined indicator which is one of the indicators, an inter-unit communication section configured to transmit and receive inter-unit signals to and from the other usage-side unit, an information originating section configured to originate alarm information, send the originated alarm information to the predetermined indicator by means of a first unit signal, and send the originated alarm information to the other usage-side unit by means of an inter-unit signal, and an inter-unit signal processing section configured to, when alarm information has been received from the other usage-side unit by means of an inter-unit signal, transfer the received alarm information to the predetermined indicator by means of a second unit signal, and, if there is the rest usage-side unit which has not originated nor received the received alarm information, transfer the received alarm information to the rest usage-side unit by means of another inter-unit signal; and each indicator has a mode management section configured to accept selection from a plurality of operation modes of the indicator including a first mode, a unit-side communication section configured to receive or acquire first and second unit signals from the usage-side unit, and an indicator output section configured to, when alarm information has been received or acquired by means of a second unit signal during the indicator is operating in the first mode, output the alarm information.

With this heat-pump system according to the first aspect, it is possible to switch, just by selecting the first mode or not, the behaviour of each indicator regarding whether to output alarm information originated by the usage-side unit other than the predetermined usage-side unit which transmits first and second unit signals to the indicator. Thereby, it is possible to easily and arbitrarily impart, to any of the indicators, a function to output alarm information regardless of its origin. An information output device having a configuration different from the indicators and dedicated to outputting all alarm information is not required anymore. Moreover, compared with a system in which an information output device is connected to each of the usage-side units, it is possible to easily install a central information output function. Hence, a refrigerant system with high manageability and high usability can be provided at a low cost.

According to a preferred embodiment of the refrigerant system mentioned above, the indicator output section is further configured to, when alarm information has been received or acquired by means of a first unit signal, output the alarm information.

With this configuration, the indicator can output alarm information regardless of its operation mode if the alarm information is originated by the predetermined usage-side. In the above-mentioned case of the hotel for instance, only information originated by the air-conditioning unit in the guest room may be important for a guest using the guest room, while all alarm information originated by any of the indoor-units may be important for the monitoring person. Thus, by the heat-pump system according to the above embodiment, both an information output suitable for a supervisor of the whole system and an information output suitable for a user of a specific usage-side unit can be achieved by the same indicator, and these different types of information output are selectable for each indicator as desired. Hence, it is possible to further improve the usability of the refrigerant system at low cost.

A second aspect of the present invention provides an indicator for outputting information relating to a heat-pump system including a plurality of usage-side units which form a communication network, comprising: a mode management section configured to accept selection from a plurality of operation modes of the indicator including a first mode; a unit-side communication section configured to receive or acquire first and second unit signals from a predetermined usage-side unit which is one of the usage-side units, the first unit signal being used for information originated by the predetermined usage-side unit, the second unit signal being used for information not originated by the predetermined usage-side unit; and an indicator output section configured to, when alarm information has been received or acquired by means of a second unit signal during the indicator is operating in a first mode, output the alarm information.

With this indicator according to the second aspect, it is possible to switch, just by selecting the first mode or not, the behaviour of each indicator regarding whether to output the alarm information originated by the usage-side unit other than the predetermined usage-side unit which transmits first and second unit signals to the indicator. Thereby, it is possible to easily and arbitrarily impart, to any of the indicators, a function to output alarm information regardless of its origin. An information output device having a configuration different from the indicators and dedicated to outputting all alarm information is not required anymore. Hence, a refrigerant system with high manageability and high usability can be provided at a low cost.

According to a preferred embodiment of the indicator mentioned above, the indicator output section is further configured to, when alarm information has been received or acquired by means of a first unit signal, output the alarm information.

With this configuration, the indicator can output alarm information regardless of its operation mode if the alarm information is originated by the predetermined usage-side unit. Hence, it is possible to further improve the usability of the refrigerant system at low cost.

According to another preferred embodiment of any one of the indicators mentioned above, the indicator further comprises: a unit signal processing section configured to, when information has been received or acquired by means of a second unit signal during the indicator is not operating in the first mode, restrain the information from being outputted by the indicator output section.

With this configuration, the indicator does not output the alarm information if the first mode is not selected and the alarm information is not originated by its predetermined usage-side unit, while allowing other information to be outputted. In other words, when the first mode is selected, the indicator outputs alarm information originating from any of the plurality of usage-side units, and, when the first mode is not selected, the indicator outputs alarm information only if it is originated by the predetermined usage-side unit. Thereby, it is possible to output various information from the indicators while limiting the output of alarm information to the case where the predetermined unit of the indicator has originated the alarm information and the case where the first mode has been selected to the indicator. Hence, it is possible to further improve the usability of the refrigerant system at low cost.

According to further another preferred embodiment of any one of the indicators mentioned above which has the unit signal processing section, the unit signal processing section is further configured to, when non-alarm information has been received or acquired by means of any of first and second signals during the indicator is operating in the first mode, restrain the non-alarm information from being outputted by the indicator output section.

With this configuration, the indicator to which the first mode has been selected does not output information unless it is the alarm information. Thereby, it is possible to prevent the indicator operating in the first mode from outputting unnecessary information. Hence, it is possible to further improve the usability of the refrigerant system at low cost.

According to further another preferred embodiment of any one of the indicators mentioned above which has the unit signal processing section, the operation modes further includes a second mode; and the unit signal processing section is further configured to, when non-alarm information has been received or acquired by means of a first unit signal during the indicator is operating in the second mode, restrain the non-alarm information from being outputted by the indicator output section.

With this configuration, the indicator does not output information if the second mode is selected and the information is originated by its predetermined usage-side unit but not the alarm information. Thereby, it is possible to easily and arbitrarily impart, to any of the indicators, a function to output only the alarm information originated by its predetermined usage-side unit. The user of the predetermined usage-side unit can discern the alarm information originated by the predetermined usage-side unit without being bothered by other unnecessary information. Hence, in a case where only alarm information is required, it is possible to further improve the usability of the refrigerant system at low cost.

According to further another preferred embodiment of any one of the indicators mentioned above, the indicator further comprises: a terminal-side communication section configured to receive terminal signals from a mobile terminal by means of wireless communication, wherein the mode management section is configured to, when a request on the selection from the operation modes has been received by means of a terminal signal, accept the request.

With this configuration, whether or not to operate in the first mode is changed according to the mode information received from the mobile terminal. Thereby, it is possible to select the first mode as desired by using the mobile terminal which is movable and different from the indicator. Thus, a human interface dedicated only for accepting the mode selection can be omitted from the indicator. Thereby, production cost of the indicator can be reduced, and usability of the refrigerant system is further improved.

According to further another preferred embodiment of any one of the indicators mentioned above which has the terminal-side communication section, the unit-side communication section is further configured to transmit indicator signals to the predetermined usage-side unit and, when address information which is to be set as identification information of the predetermined usage-side unit has been received by means of a terminal signal, transfer the address information to the predetermined usage-side unit by means of an indicator signal.

With this configuration, the address information received from the mobile terminal is transferred the predetermined usage-side unit. Thereby, it is possible to set new identification information to the predetermined usage-side unit by using the mobile terminal which is movable and different from the indicator. A human interface dedicated only for receiving the new identification setting can be omitted from the indicator. Thereby, production cost of the indicator can be reduced, and usability of the refrigerant system is further improved.

According to further another preferred embodiment of any one of the indicators mentioned above, the alarm information includes identification information of usage-side units in which an abnormality has occurred.

With this configuration, when the alarm information is received or acquired, the indicator can notify a user of both the occurrence of the abnormality and the identification information of the usage-side unit in which the abnormality has occurred. Thereby, it is possible for the user to discern where the abnormality has occurred. Hence, the manageability of the heat-pump system can be further improved at a low cost.

According to further another preferred embodiment of any one of the indicators mentioned above with which the alarm information includes the identification information, the abnormality includes a refrigerant leakage.

With this configuration, it is possible to inform the user of the occurrence of the refrigerant leakage. Thus, it is possible to further improve the manageability and safety of the refrigerant system at low cost.

A third aspect of the present invention provides a usage-side unit as one of a plurality of usage-side units of a heat-pump system, comprising: an indicator-side communication section configured to transmit first and second unit signals to an indicator, an inter-unit communication section configured to transmit and receive inter-unit signals to and from the other usage-side unit, an information originating section configured to originate alarm information, send the originated alarm information to the indicator by means of a first unit signal, and send the originated alarm information to the other usage-side unit by means of an inter-unit signal, and an inter-unit signal processing section configured to, when alarm information has been received by means of an inter-unit signal, transfer the received alarm information to the indicator by means of a second unit signal, and, if there is the rest usage-side unit which has not originated nor received the received alarm information, transfer the received alarm information to the rest usage-side unit by means of another inter-unit signal.

With this usage-side unit according to the third aspect, the alarm information originated in any of the plurality of the usage-side unit is to be shared by them. The shared alarm information is sent by each usage-side unit to an indicator by means of a first unit signal when the alarm information has been originated by the usage-side unit itself, and by means of a second unit signal when the alarm information has been not originated by the usage-side unit itself. Thereby, it is possible to send all alarm information regardless of its origin to the indicator while allowing the indicator to know whether or not the sent alarm information was originated by the usage-side unit. This makes possible for the indicator to select, from among all shared alarm information, alarm information to be outputted according to origins of the alarm information.

According to a preferred embodiment of the usage-side unit mentioned above, the indicator-side communication section is further configured to receive indicator signals from the indicator; the usage-side unit further comprises an indicator signal processing section configured to, when address information which is to be set as identification information of the usage-side unit has been received by means of an indicator signal, set the address information as identification information of the usage-side unit; and the information originating section is configured to, when an abnormality has occurred in the usage-side unit, originate alarm information including the set identification information.

With this configuration, it is possible to, when the abnormality has occurred in the usage-side unit, make the predetermined indicator notify a user of both the occurrence of the abnormality and the identification information of the usage-side unit in which the abnormality has occurred. Thereby, it is possible for the user to discern where the abnormality has occurred. Hence, the manageability of the heat-pump system can be further improved at a low cost.

A fourth aspect of the present invention provides an information output method in an indicator for outputting information relating to a heat-pump system including a plurality of usage-side units which form a communication network, comprising: accepting selection from a plurality of operation modes of the indicator including a first mode; receiving or acquiring any of first and second unit signals from a predetermined usage-side unit which is one of the usage-side units, the first unit signal being used for information originated by the predetermined usage-side unit, the second unit signal being used for information not originated by the predetermined usage-side unit; and, when alarm information has been received or acquired by means of a second unit signal during the indicator is operating in a first mode, outputting the alarm information.

With this information output method according to the fourth aspect, it is possible to switch, just by selecting the first mode or not, the behaviour of each indicator regarding whether to output the alarm information originated by the usage-side unit other than the predetermined usage-side unit which transmits first and second unit signals to the indicator. Thereby, it is possible to easily and arbitrarily impart, to any of the indicators, a function to output alarm information regardless of its origin. An information output device having a configuration different from the indicators and dedicated to outputting all alarm information is not required anymore. Hence, a refrigerant system with high manageability and high usability can be provided at a low cost.

According to a preferred embodiment of the information output method mentioned above, the method further comprises, when alarm information has been received or acquired by means of a first unit signal, outputting the alarm information.

With this configuration, the indicator can output alarm information indicated by a first unit signal regardless of its operation mode if the alarm information is originated by the predetermined usage-side unit. Hence, it is possible to further improve the usability of the refrigerant system at low cost.

DESCRIPTION OF EMBODIMENTS

Detailed Description of Preferred Embodiment

A preferred embodiment of a heat-pump system according to the present invention will be described with reference to the drawings.

<System Configuration>

Figure 1:
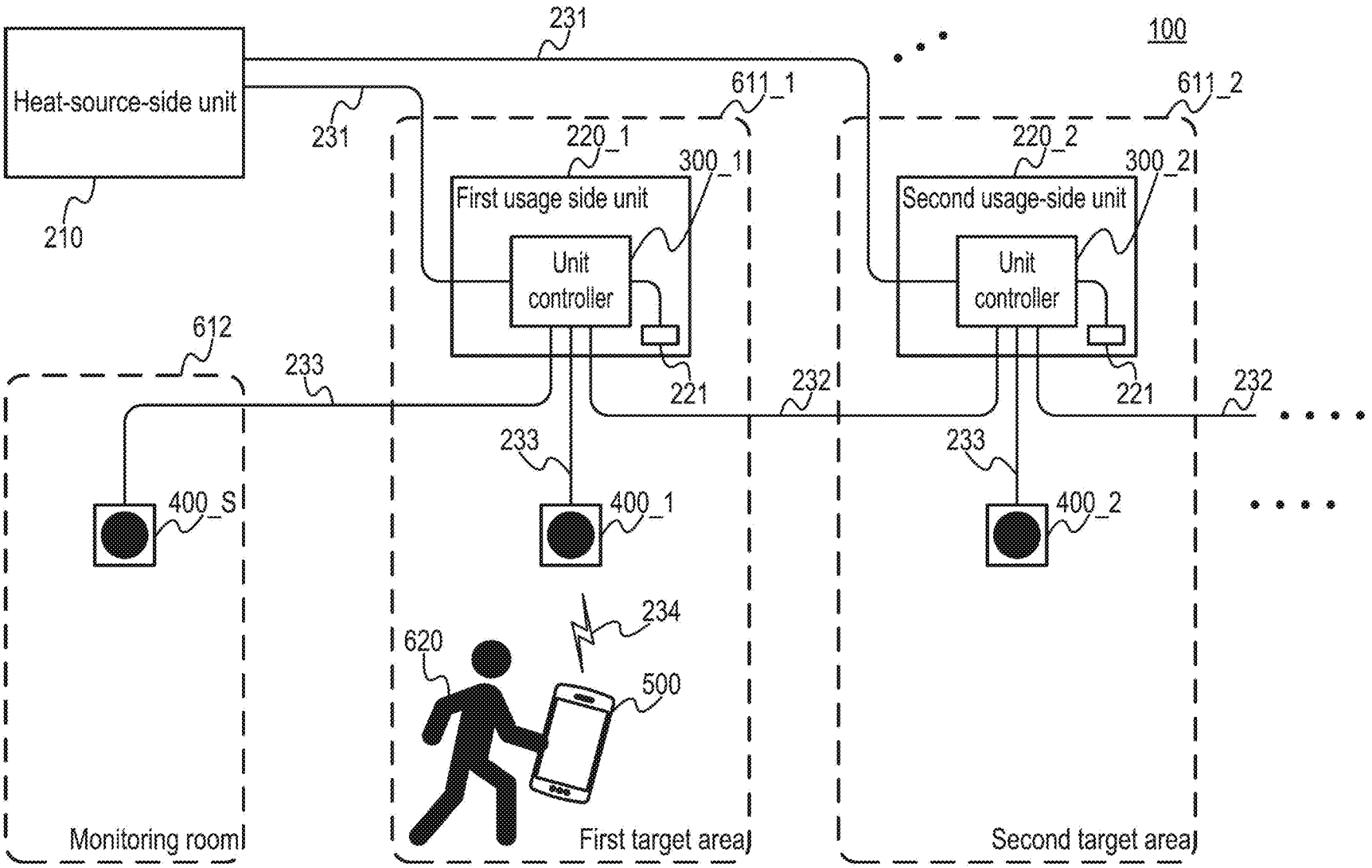
FIG. 1 shows a schematic configuration of a heat-pump system according to an embodiment of the present invention.

FIG. 1 shows a schematic configuration of a heat-pump system according to an embodiment of the present invention.

As shown in FIG. 1. a heat-pump system 100 according to the present embodiment comprises a heat-source-side unit 210, a plurality of usage-side units 220 each having a unit controller 300, a plurality of indicators 400, and a mobile terminal 500. For instance, the heat-pump system 100 is an air-conditioning system, and the heat-source-side unit 210 and the usage-side units 220 are an outside unit and indoor units, respectively.

In this embodiment, the explanations will be made on a premise that: the first usage-side unit 220_1 having the first unit controller 300_1, and the first indicator 400_1 are disposed in a first target area 611_1; the second usage-side unit 220_2 having the second unit controller 300_2, and the second indicator 400_2 are disposed in a second target area 611_1; and the supervisor-use indicator 400_S is disposed in a monitoring room 612. However, the arrangement of these devices is not limited to this. Two or more of the usage-side units 220 may be disposed in the same target area 611. Two or more of the indicators 400 may be disposed in the same target area 611. The supervisor-use indicator 400_S may be disposed in a different place, e.g. one of the target areas 611. Two or more of the supervisor-use indicators 400_S may also be provided.

All the unit controllers 300 including the first and second unit controllers 300_1, 300_2 have substantially the same configuration. Thus, each of the unit controllers 300 will be called just as "the unit controller 300" when the explanation is applicable to all the unit controllers 300. Similarly, each of the usage-side units 220 including the first and second unit units 220_1, 220_2 will also be called just as "the usage-side unit 220" when the explanation is applicable to all the usage-side units 220. All the indicators 400 including the first and second indicators 400_1, 400_2 and the supervisor-use indicator 400_S also have substantially the same configuration. Thus, in this embodiment, each of the indicators 400 is also called just as "the indicator 400" when the explanation is applicable to all the indicators 400.

The heat-source-side unit 210 is configured to supply cold heat and/or hot heat to the usage-side units 220 by circulating refrigerant via refrigerant pipes (not shown). The heat-source-side unit 210 is also configured to communicate with the usage-side units 220 via wired/wireless communication paths 231. These communication paths 231 may be established by LAN (Local Area Network).

The usage-side unit 220 is configured to utilize the cold heat and/or hot heat supplied from the heat-source-side unit 210. For instance, the usage-side unit 220 has a heat exchanger and an air blower (not shown) to perform a heat exchange between the refrigerant and an air in the target area 611. The usage-side unit 220 also has a leakage sensor 221 in addition to the unit controller 300.

The leakage sensor 221 is configured to, when a refrigerant leakage has occurred in the usage-side unit 220, detect this refrigerant leakage, and inform of it to the unit controller 300. The leakage sensor 221 may be a semi-conductor gas sensor reactive to the refrigerant, and is disposed inside or outside the usage-side unit 220. The usage-side unit 220 need not necessarily include the leakage sensor 221, i.e. may utilize an external leakage sensor. In this case, the unit controller 300 has a wired/wireless communication interface for communicating with the external leakage sensor to transmit signals thereto or/and receive signals therefrom.

The unit controllers 300 of the usage-side units 220 are configured to form a communication network via wired/wireless communication paths 232. This communication network may be established by LAN (Local Area Network). For instance, the unit controllers 300 are connected in series by the wired/wireless communication paths 232 as shown in FIG. 1. In this embodiment, the explanations will be made on a premise that the first unit controller 300_1, the second unit controller 300_2, and the other unit controllers (not shown) are serially connected in this order. However, the connection configuration of the unit controllers 300 is not limited to this.

The unit controller 300 is configured to communicate with one or more of the indicators 400 via one or more of via wired/wireless communication paths 233. These communication paths 233 may be established by LAN (Local Area Network). In this embodiment, the explanations will be made on a premise that the first indicator 400_1 and the supervisor-use indicator 400_S are connected with the first unit controller 300_1, and that the second indicator 400_2 is connected with the first unit controller 300_1. Thus, the first indicator 400_1 and the supervisor-use indicator 400_S can directly communicate with the first unit controller 300_1, but not with the any other unit controller 300 such as the second unit controller 300_2. The second indicator 400_2 can directly communicate with the second unit controller 300_2, but not with the any other unit controller 300 such as the first unit controller 300_1.

Hereinafter, the unit controller 300 with which the indicator 400 under explanation can communicate, without an intervention of any other unit controller 300, will be referred to as "the connecting unit controller 300" as necessary. Similarly, the usage-side unit 220 having the connecting unit controller 300 will be referred to as "the connecting usage-side unit 220" as necessary. The indicator 400 with which the unit controller 300 under explanation can communicate, without an intervention of any other unit controller 300, will also be referred to as "the connecting indicator 400" as necessary.

The unit controller 300 is also configured to receive information from the connecting indicator 400, and operate according to the received information. Thus, the first unit controller 300 operates according to information received from the first indicator 400_1 and the supervisor-use indicator 400_S, the second unit controller 300 operates according to information received from the second indicator 400_2. However, the supervisor-use indicator 400_S does not necessarily have a function of transmitting such information to the first indicator 400_1. This limitation of functions may be achieved by later-mentioned setting of a first mode.

The unit controller 300 is further configured to originate alarm information, and share the originated alarm information with all the other unit controllers 300 by using the above-mentioned communication network formed by the unit controllers 300. The unit controller 300 is also configured to send the shared alarm information to the connecting indicator 400 regardless of whether or not the alarm information is originated by the unit controller 300 itself.

For instance, when the first unit controller 300_1 has originated alarm information, the first unit controller 300_1 transmits the originated alarm information to the second unit controller 300_2, the first indicator 400_1, and the supervisor-uses indicator 400_S. The second unit controller 300_2 transfers the received alarm information to the second indicator 400_2 and the further other unit controller 300 (not shown). Meanwhile, when the second unit controller 300_2 has generated alarm information, the second unit controller 300_2 transmits the originated alarm information to the first unit controller 300_1, the further other unit controller (not shown), and the second indicator 400_2. The first unit controller 300_1 transfers the received alarm information to the first indicator 400_1 and the supervisor-use indicator 400_S.

In this embodiment, the explanations will be made on a premise that the unit controller 300 is configured to originate alarm information when a refrigerant leakage has occurred in the usage-side unit 220 to which the unit controller 300 belongs, e.g. when the leakage sensor 221 which belongs to the same usage-side unit 220 has detected a refrigerant leakage. However, a trigger of originating alarm information is not limited to this. The trigger may be an occurrence of another abnormality, such as an excessive increase in refrigerant pressure, an excessive increase in air resistance, and/or other malfunctions of the usage-side unit 220.

The indicator 400 is configured to output information relating to the heat-pump system 100. More specifically, the indicator 400 is configured to receive or acquire information from the connecting unit controller 300, and output the received or acquired information. Here, outputting information may include outputting: a visual image such as a picture, a symbol, a text or light; a sound such as a buzzer or a speech sound; and/or a vibration which represent a type and/or a content of information and indicates a reception of the information. Meanwhile, as detailed later, the indicator 400 is also configured to restrict its information output depending on: whether or not the information has been originated by the connecting unit controller 300; whether or not the information is alarm information, and whether or not the indicator 400 is operating in a specific mode.

In addition, the indicator 400 is configured to communicate with the mobile terminal 500 via a wireless communication path 234. This wireless communication is preferably a short-range radio communication, such that only one of the indicators 400 can establish this communication with the mobile terminal 500 at a time. For instance, when the mobile terminal 500 in the first target area 611_1, only the first indicator 400_1 among the indicators 400 can communicate with the mobile terminal 500. The indicator 400 is configured to receive information from the mobile terminal 500, operate according to the received information, and further transfer the received information to the unit controller 300 depending on the type of the information.

Figure 2:
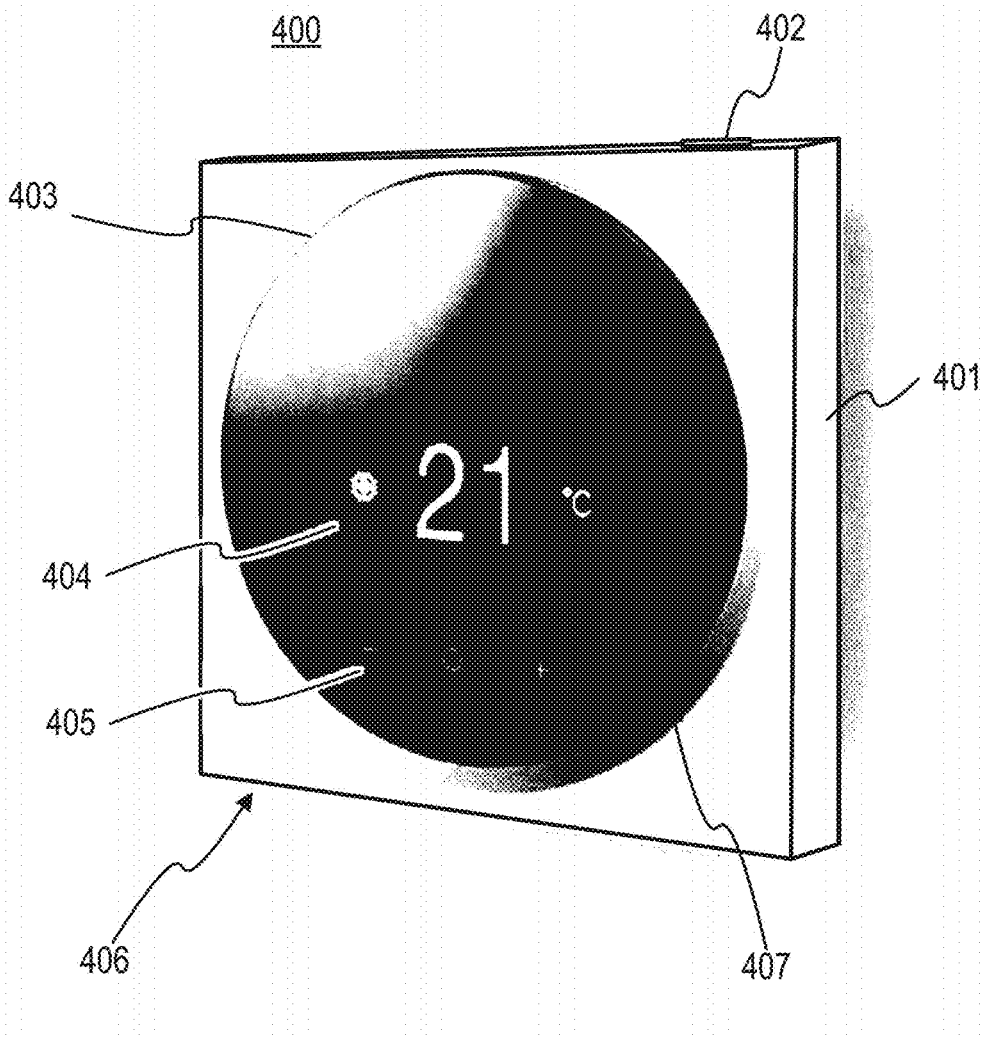
FIG. 2 shows an example of appearance of an indicator shown in FIG. 1.

FIG. 2 shows an example of appearance of the indicator 400.

As shown FIG. 2, the indicator 400 may have a casing 401, an on/off button 402, a display panel 403 including a display area 404 and an operation area 405, a loudspeaker 406, and an LED (Light Emitting Diode) 407.

The casing 401 has a plate-like outer shape, and is formed with a back surface for being attached to a wall or the like and a main surface on the opposite side of the back surface. The casing 401 covers most part of the indicator 400. The on/off button 402 is disposed on one of the surfaces of the casing 401, and configured to receive user operations for switching on and off the indicator 400. The display panel 403 is disposed on the main surface of the casing 401, and configured to display information by means of texts, symbols, pictures or the like. The display panel 403 may be a touch panel display. The display area 404 is configured to change its display contents. The operation area 405 is configured to receive user operations for switching on and off the information display by the indicator 400. The operation area 405 is also configured to receive user operations for changing the display contents, the operation of the indicator 400, and the operation of the usage-side unit 220. The loudspeaker 406 is configured to output information by means of a sound. The LED 407 is configured to output information by means of light.

The mobile terminal 500 of FIG. 1 is configured to receive requests relating to the heat-pump system 100 from a user 620 of mobile terminal 500. The user 620 is a monitoring person of the heat-pump system 100 who normally resides in the monitoring room 612, for instance. The mobile terminal 500 is also configured to transmit information based on the received request to the indicator 400 which is connected with the mobile terminal 500 via the wireless communication path 234. The mobile terminal 500 may be further configured to receive information from the indicator 400, and output the received information by means of a visual image, a sound, and/or a vibration. The mobile terminal 500 may be a smart phone, a tablet device or the like.

Although not shown, the unit controller 300, the indicator 400, and the mobile terminal 500 each include an arithmetic circuit such as a CPU (Central Processing Unit), a work memory used by the CPU such as a RAM (Random Access Memory), and a recording medium storing control programs and information used by the CPU such as a ROM (Read Only Memory). The unit controller 300, the indicator 400, and the mobile terminal 500 are each configured to perform information processing and signal processing by the CPU executing the control programs to control operation thereof, so as to achieve their functions and operations.

With the above heat-pump system 100, it is possible to output information relating to the heat-pump system 100, including alarm information relating to any of the usage-side units 220, from any of the indicators 400. Moreover, it is possible for the user 620 to operate each of the usage-side units 220 and each of the indicators 400 by using the mobile terminal 500 such that, for instance, desired information is outputted from the closest indicator 400.

However, there are cases where outputting all the information originated by any of the usage-side units 220 is not preferable. For instance, when a refrigerant leakage has occurred in the second usage-side unit 220_2, the alarm information should be outputted from the second indicator 400_2 and the supervisor-use indicator 400_S, but not from the first indicator 400_1. Meanwhile, the information originated by the first usage-side unit 220_1 should be outputted from the first indicator 400_1 and the supervisor-use indicator 400_S, but not from the second indicator 400_2. In this regard, the heat-pump system 100 is configured to regulate the information output from the indicators 400 such that only necessary information output is performed in each of the indicators 400.

<Functional Configuration of Unit Controller>

Figure 3:
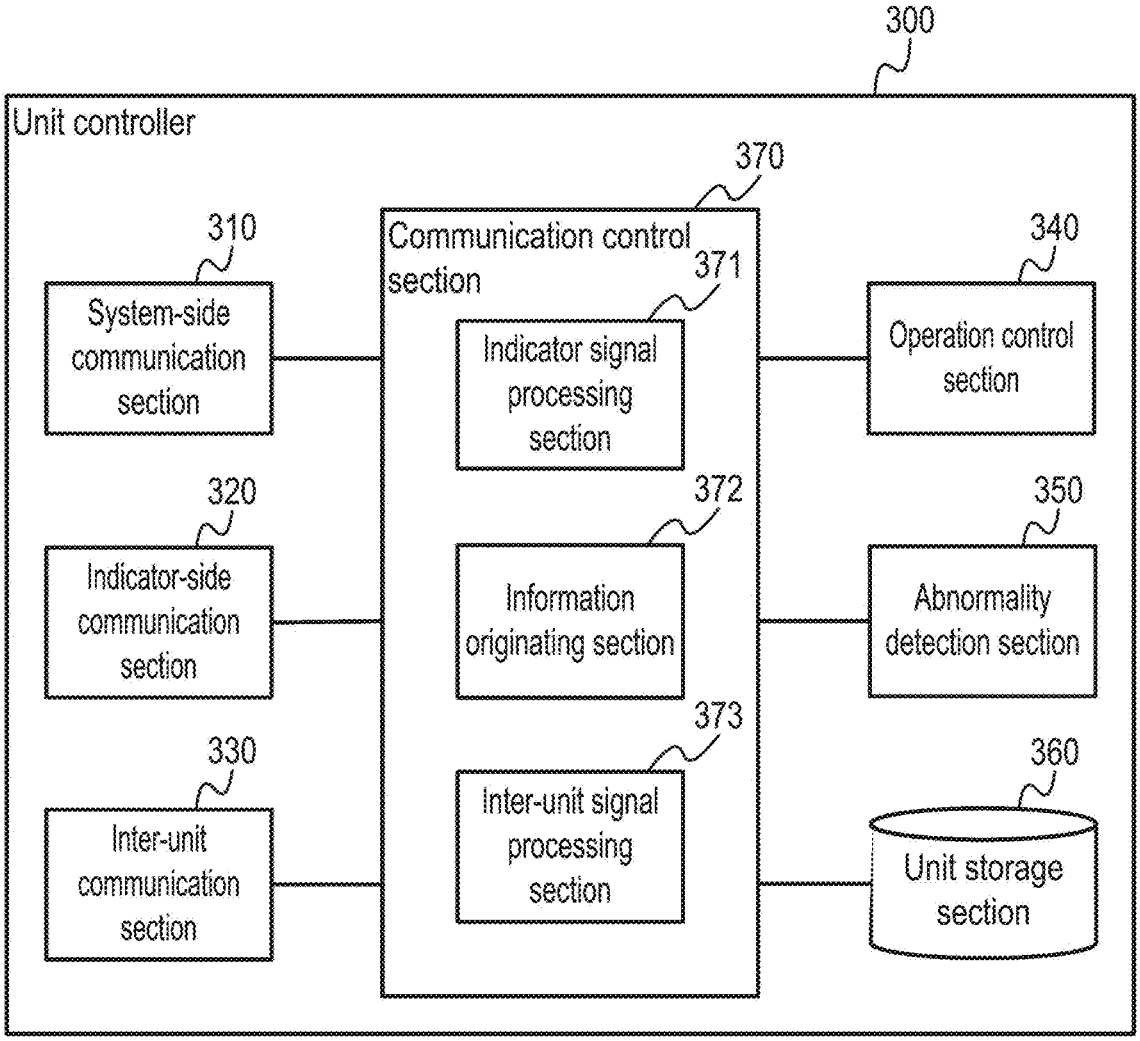
FIG. 3 is a block diagram indicating a functional configuration of a unit controller shown in FIG. 1.

FIG. 3 is a block diagram indicating a functional configuration of the unit controller 300.

As shown in FIG. 3, the usage-side unit 220 includes a system-side communication section 310, an indicator-side communication section 320, an inter-unit communication section 330, an operation control section 340, an abnormality detection section 350, a unit storage section 360, and a communication control section 370.

The system-side communication section 310 is configured to establish the communication path 231 with the heat-source-side unit 210 to communicate therewith (see FIG. 1).

The indicator-side communication section 320 is configured to establish the communication path 233 with the indicator 400 (a predetermined indicator) to communicate therewith (see FIG. 1). In particular, the indicator-side communication section 320 is configured to transmit first unit signals and second unit signals to the indicator 400, and receive indicator signals from the indicator 400. Here, a first unit signal is a signal used for information originated by the unit controller 300 itself, and a second unit signal is a signal used for information not originated by the unit controller 300 itself. Details regarding the first and second unit signals will be explained later. The indicator-side communication section 320 may be connected with a plurality of the indicators 400.

The inter-unit communication section 330 is configured to establish the communication path 232 with the other unit controller 300 to communicate therewith (see FIG. 1). In particular, the inter-unit communication section 330 is configured to transmit and receive inter-unit signals to and from the other unit controller 300 of the other usage-side unit 220. The inter-unit communication section 330 may be connected with a plurality of the other unit controllers 300.

The system-side communication section 310, the indicator-side communication section 320, and the inter-unit communication section 330 may be a LAN interfaces, and may use the same communication protocol or different communication protocols.

The operation control section 340 is configured to control the operation of the usage-side unit 220 for utilizing the cold heat and/or hot heat supplied from the heat-source-side unit 210 according to operation information provided from the communication control section 370. For instance, the operation control section 340 is configured to control the flow of the refrigerant in the heat exchanger and operation of the air blower. The operation information may include instructions for changing a target temperature of the air in the target area 611, changing an air volume level of the air blower, changing an operation mode between a cooling operation mode and a heating operation mode, on/off of the operation for utilizing the cold heat and/or hot heat, and so on.

The abnormality detection section 350 is configured to, when a predetermined abnormality has occurred in the usage-side unit 220, detect this occurrence of the abnormality. For instance, the abnormality detection section 350 is configured to receive the information from the leakage sensor 221 when a refrigerant leakage has occurred (see FIG. 1).

The unit storage section 360 stores information in a form readable and rewritable by the communication control section 370. The stored information includes identification (ID) information of the usage-side unit 220. The unit storage section 360 may store an initial ID information which has been set to the usage-side unit 220 in advance. In this embodiment, the explanations will be made on a premise that a text "01" has been initially set to the first usage-side unit 220_1 and a text "02" has been initially set to the second usage-side unit 220_2.

The communication control section 370 is configured to control the communications with the heat-source-side unit 210, the one or more of other unit controllers 300, and the one or more of connecting indicators 400. The communication control section 370 may be achieved by an application software installed to or updated in the unit controller 300. The communication control section 370 includes an indicator signal processing section 371, an information originating section 372, and an inter-unit signal processing section 373.

The indicator signal processing section 371 is configured to receive indicator signals transmitted from the connecting indicator 400 via the indicator-side communication section 320, and process the received indicator signals. More specifically, the indicator signal processing section 371 is configured to, when operation information has been received by means of an indicator signal, pass it to the operation control section 340. In addition, the indicator signal processing section 371 is configured to, when address information has been received by means of an indicator signal, rewrite the ID information stored in the unit storage section 360 by the obtained address information or add the obtained address information to the unit storage section 360 so as to set it as ID information of the usage-side unit 220.

The indicator signal processing section 371 is also configured to, when indication information has been received by means of an indicator signal, pass it to the information originating section 372. The indication information is information which indicates that status information indicating the operation status of the usage-side unit 220 is requested from the indicator 400.

It should be noted that information which is sent, transferred, received, or acquired by means of a signal may be information contained in the signal, information a location of which is specified by the signal, or information an identification of which has been shared by a sender of the signal and a receiver of the signal in advance is specified by the signal. Thus, sending or transferring information by means of a signal may be transmitting a signal containing the information itself, transmitting a signal specifying a location of the information, or transmitting a signal specifying an identification of the information. Receiving or acquiring information by means of a signal may be extracting the information included in a signal, accessing a location specified by a signal to obtain the information, or identifying the information from an identification specified by a signal. A signal containing information, specifying a location of information, or specifying an identification of information may be expressed as a signal "indicating" the information.

The information originating section 372 is configured to originate information including alarm information. The information originating section 372 may originate, as mentioned above, alarm information when an occurrence of a refrigerant leakage has been informed of by the leakage sensor 221 via the abnormality detection section 350. The information originating section 372 is further configured to send the originated information to the connecting indicator 400 by a first unit signal via the indicator-side communication section 320, and also send the same originated information to the other usage-side unit 220 by means of an inter-unit signal via the inter-unit communication section 330.

The information originating section 372 is preferably configured to read the latest ID information of the usage-side unit 220 from the unit storage section 360, and embed the read ID information into the alarm information. Thereby, the alarm information includes ID information of the usage-side units 220 in which an abnormality has occurred. The latest ID information may be the initially set ID information if any other ID information has been set, or the ID information subsequently and lastly set by the indicator signal processing section 371.

The information originating section 372 is also configured to originate the status information and send it to the indicator 400 by a first unit signal via the indicator-side communication section 320. The status information may indicate the operation mode, the target temperature, the air volume level of the air blower or the like of the usage-side unit 220. The information originating section 372 may send the status information autonomously and periodically, or send the status information passively upon receiving the indication information from the indicator 400 via the indicator signal processing section 371.

The inter-unit signal processing section 373 is configured to receive inter-unit signals transmitted from the unit controller 300 of the other usage-side unit 220 via the inter-unit communication section 330, and process the received inter-unit signals. More specifically, the inter-unit signal processing section 373 is configured to, when information has been received by means of an inter-unit signal, send it to the indicator 400 (a predetermined indicator) by a second unit signal via the indicator-side communication section 320. Such information includes alarm information originated by one of the other usage-side units 220.

The inter-unit signal processing section 373 is also configured to, if there is any rest usage-side unit 220, transfer the information to the rest usage-side unit 220 by means of another inter-unit signal via the inter-unit communication section 330. Here, the "rest usage-side unit 220" means the other usage-side unit 220 which has not originated nor received the information that the inter-unit signal processing section 373 received.

The unit controller 300 may also be configured to operate according to commands from the heat-source-side unit 210, and send information relating to the usage-side unit 220 to the heat-source-side unit 210.

With the above configuration, the unit controller 300 can originate alarm information including ID information, share alarm information with the other the unit controller 300 and the connecting indicator 400 regardless of the origin of the alarm information. The unit controller 300 can also differentiate alarm information originated by itself and other alarm information from each other by using a first unit signal for the former alarm information and a second unit signal for the latter alarm information.

The difference of a first unit signal and a second unit signal is not limited to a certain form, but need to be shared between the usage-side unit 220 and the connecting indicator 400 in advance such that the indicator 400 can distinguish them. For instance, a first unit signal and a second unit signal are: transmitted using predetermined different commands; transmitted in predetermined different timings in a transmission frame; and/or appended with predetermined different symbols. The indicator 400 may request the connecting usage-side unit 220 to send information to the indicator 400 specifying the origin of the information. In this case, the transmitted signal in reply to the request specifying the connecting usage-side unit 220 may be a first unit signal, and the transmitted signal in reply to the request not specifying the connecting usage-side unit 220 may be a second unit signal.

<Functional Configuration of Indicator>

Figure 4:
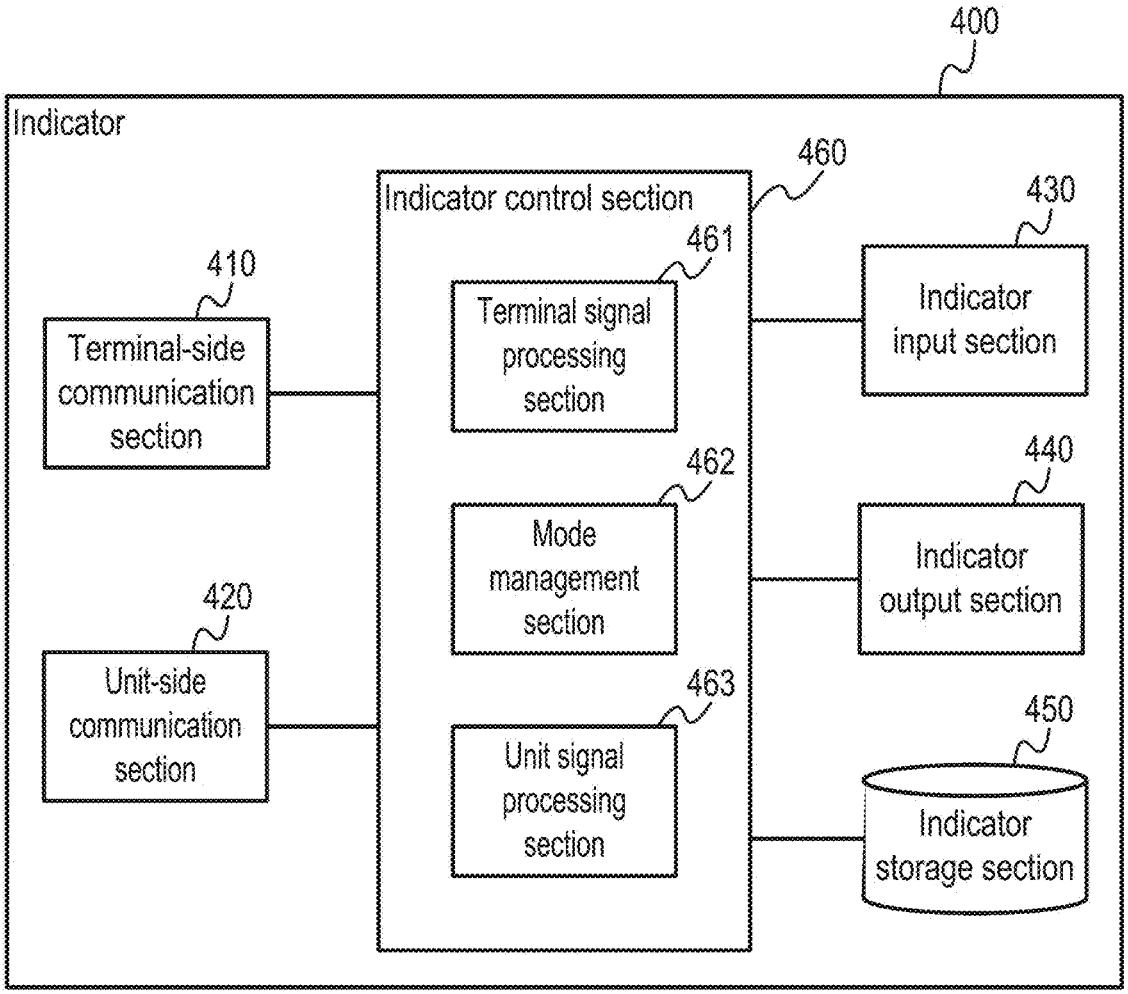
FIG. 4 is a block diagram indicating a functional configuration of an indicator shown in FIG. 1.

FIG. 4 is a block diagram indicating a functional configuration of the indicator 400.

As shown in FIG. 4, the indicator 400 includes a terminal-side communication section 410, a unit-side communication section 420, an indicator input section 430, an indicator output section 440, an indicator storage section 450, and an indicator control section 460.

The terminal-side communication section 410 is configured to establish the communication path 234 with the mobile terminal 500 to communicate therewith (see FIG. 1). In particular, the terminal-side communication section 410 is configured to receive terminal signals from the mobile terminal 500. The terminal-side communication section 410 may be a short-range radio communication interface device.

The unit-side communication section 420 is configured to establish the communication path 233 with the unit controller 300 (a predetermined usage-side unit) to communicate therewith (see FIG. 1). In particular, the unit-side communication section 420 is configured to transmit indicator signals to the unit controller 300, and receive or acquire first and second unit signals from the unit controller 300. The system-side communication section 310 may be a LAN interface.

The indicator input section 430 is configured to receive user operations to the indicator 400. The indicator input section 430 may be a mechanical key, a mechanical dial, a touch panel, a microphone, or the like. The indicator input section 430 may include the above-mentioned on/off button 402 and/or operation area 405 (see FIG. 2).

The indicator output section 440 is configured to output information provided from the indicator control section 460 by a visual image and/or a sound. The information to be outputted includes alarm information and status information. The indicator output section 440 may be a loudspeaker, a display device, an electric light, a vibrator, or the like. The indicator output section 440 may include the above-mentioned display area 404, loudspeaker 406, and/or LED 407.

The indicator storage section 450 stores information in a form readable and rewritable by the indicator control section 460. The information to be stored includes mode setting information that indicates which of a plurality of predetermined operation modes has been set to indicator 400. In the different predetermined operation modes, the indicator 400 behaves in different manners.

In this embodiment, the predetermined operation modes includes a first mode, a second mode, and a third mode. The first mode is an operation mode for outputting information from the indicator 400 regardless of the origin of the information. The second mode is an operation mode for outputting only alarm information originated by the connecting unit controller 300. The third mode is an operation mode for outputting only information originated by the connecting unit controller 300. However, the predetermined operation modes are not limited to these modes. For instance, the predetermined operation modes may include only the first and second modes, or only the first and third modes. The indicator storage section 450 may store mode setting information indicating the third mode as an initial operation mode which has been set to the indicator storage section 45 in advance.

The indicator control section 460 is configured to control the communications with the connecting unit controller 300 and the communications with the mobile terminal 500, and the operations of the indicator 400. The indicator control section 460 may be achieved by an application software installed to or updated in the indicator 400. The indicator control section 460 includes a terminal signal processing section 461, a mode management section 462, and a unit signal processing section 463.

The terminal signal processing section 461 is configured to receive terminal signals transmitted from the mobile terminal 500 via the terminal-side communication section 410, and process the received indicator signals. More specifically, terminal signal processing section 461 is configured to, when mode information has been received by means of a terminal signal, pass it to the mode management section 462. The mode information is information indicating a request on a selection from the above-mentioned predetermined operation modes, i.e. which of the first to third modes should be set to the indicator 400.

In addition, the terminal signal processing section 461 is configured to, when any one of the operation information, the address information, and the indication information has been received by means of a terminal signal, transfer it to the connecting unit controller 300 by means of an indicator signal via the terminal-side communication section 410.

The mode management section 462 is configured to accept selection from the above-mentioned predetermined operation modes of the indicator 400. More specifically, the mode management section 462 is configured to, when the mode information is received from the terminal signal processing section 461, rewrite the mode setting information stored in the indicator storage section 450 or add the mode setting information to the indicator storage section 450 as indicated by the received mode information. Thereby, the mode management section 462 sets the operation mode to the indicator 400 according to the received mode information. For instance, the received mode information indicates the first mode, the mode management section 462 sets the first mode to the indicator 400. The mode management section 462 may also accept the request on the operation mode selection from the user 620 via the indicator input section 430 (see FIG. 1).

The unit signal processing section 463 is configured to receive or acquire unit signals, which include the first and second unit signals mentioned above, transmitted from the connecting unit controller 300 via the unit-side communication section 420, and process the received unit signals. More specifically, the unit signal processing section 463 is configured to, when information has been received by means of any one of first and second unit signals, pass it to the indicator output section 440 such that the information is outputted. Meanwhile, the unit signal processing section 463 is also configured to regulate information output from indicator output section 440 such that only information necessary for the indicator 400 is outputted therefrom.

Figures 5, 6:
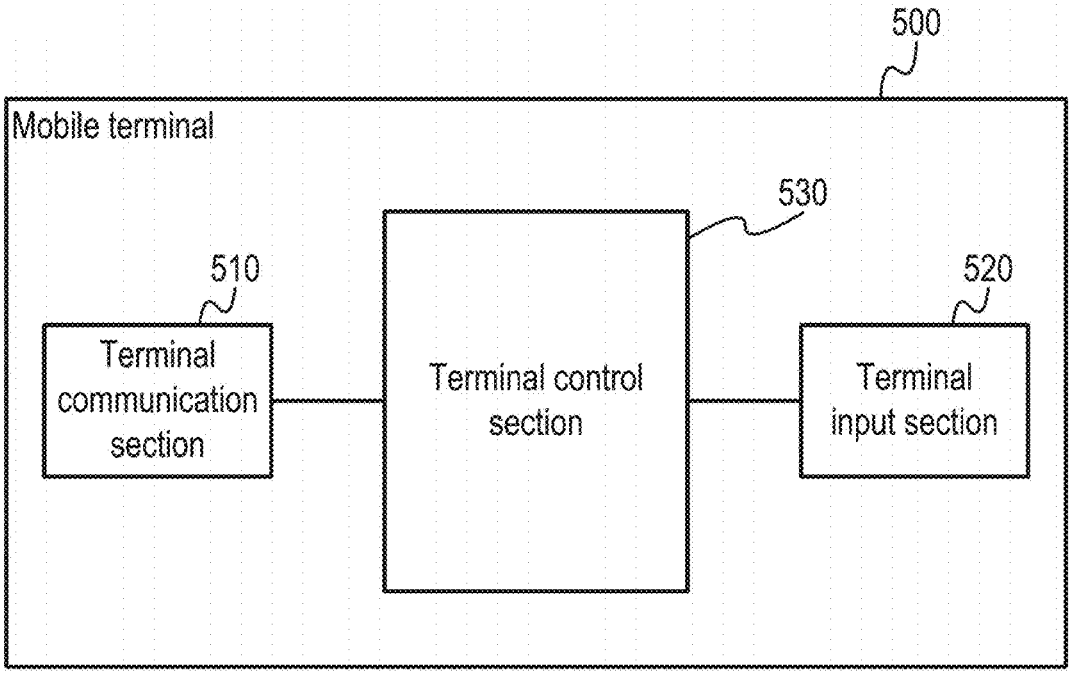
FIG. 5 is a schematic table indicating operation patterns of the indicator upon receiving a signal from the unit controller.
FIG. 6 is a block diagram indicating a functional configuration of a mobile terminal shown in FIG. 1.

FIG. 5 is a schematic table indicating operation patterns of the indicator 400 upon receiving a signal from the unit controller.

As shown in the schematic table 464 of FIG. 5, the unit signal processing section 463 switches its behaviour depending on: which of first unit signal and second unit signal has been received; whether the information indicated by the received unit signal is alarm information; and which of the first to third modes has been set to the indicator 400.

When the indicator 400 is operating in the first mode, the unit signal processing section 463 is configured to restrain information indicated by a received second unit signal and information which is not alarm information (hereinafter referred to as "non-alarm information") from being outputted by the indicator output section 440. On the other hand, if the received signal indicates alarm information, the unit signal processing section 463 allows the indicator output section 440 to output the alarm information regardless of whether the received signal is a first unit signal or a second unit signal.

When the indicator 400 is operating in the second mode, the unit signal processing section 463 is configured to restrain the information which is indicated by a first unit signal and non-alarm information from being outputted by the indicator output section 440. On the other hand, if the received signal is a first unit signal indicating alarm information, the unit signal processing section 463 allows the indicator output section 440 to output the alarm information.

When the indicator 400 is operating in the third mode, the unit signal processing section 463 is configured to restrain the information which is indicated by a second unit signal from being outputted by the indicator output section 440. On the other hand, if the received signal is a first unit signal, the unit signal processing section 463 is configured to operate according to information indicated by a first unit signal. For example, the unit signal processing section 463 allows the indicator output section 440 to output alarm information and status information indicated by a first unit signal.

In other words, the unit signal processing section 463 is configured to, when alarm information has been received or acquired by means of a second unit signal during the indicator 400 is operating in the first mode, or when alarm information has been received or acquired by means of a first unit signal, allows the indicator output section 440 to output the alarm information. Consequently, the indicator output section 440 is configured to output information indicated by a unit signal received or acquired from the usage-side unit 220, on condition that the unit signal is a second unit signal indicating alarm information and has been received or acquired during the indicator 400 is operating in the first mode, or that the unit signal is a first unit signal indicating alarm information. The unit signal processing section 463 may determine which mode has been set to the indicator 400 (i.e. in which mode the indicator 400 is operating) by referring to the mode setting information stored in the indicator storage section 450.

With the above configuration, the operation mode of the indicator 400 can be switched as desired among the first mode in which alarm information is outputted regardless of its origin, the second mode in which only alarm information originated by the connecting unit controller 300 is outputted, and the third mode in which only information originated by the connecting unit controller 300 is outputted. For instance, the first mode is suitable for the supervisor-use indicator 400_S, the third mode is suitable for the first and second indicators 400_1, 400_2, and the second mode is suitable for the indicator 400 (not shown) additionally connected to the first unit controller 300_1 or the second unit controller 300_2 (see FIG. 1).

<Functional Configuration of Mobile Terminal>

FIG. 6 is a block diagram indicating a functional configuration of a mobile terminal shown in FIG. 1.

As shown FIG. 6, the mobile terminal 500 includes a terminal communication section 510, a terminal input section 520, and a terminal control section 530.

The terminal communication section 510 is configured to establish the communication path 234 with the indicator 400 to communicate therewith (see FIG. 1). In particular, the terminal communication section 510 is configured to transmit terminal signals to the indicator 400. The terminal communication section 510 may be further configured to receive signals from the indicator 400. The terminal communication section 510 may be a short-range radio communication interface device.

The terminal input section 520 is configured to receive user operations to the mobile terminal 500. The terminal input section 520 may be a touch panel display, mechanical keys, a microphone, or the like.

The terminal control section 530 is configured to receive requests relating to the heat-pump system 100 from the user 620 via terminal input section 520, and send information according to the received request to the indicator 400 by a terminal signal via the terminal communication section 510.

More specifically, when a request for setting one of the predetermined operation modes to the indicator 400 has been received, the terminal control section 530 is configured to send mode information indicating the request. When a request for setting selected or inputted address information to be set to the user-side unit 220 has been received, the terminal control section 530 is configured to send address information indicating the request. When a request for controlling the operation of the usage-side unit 220 in a certain manner has been received, the terminal control section 530 is configured to send operation information indicating the request. When a request for outputting certain information on the operation of the usage-side unit 220, the terminal control section 530 is configured to send operation information indicating the request. The terminal control section 530 may also be configured to output or response to signals received from the indicator 400. The terminal control section 530 may be achieved by an application software installed to or updated in the mobile terminal 500.

With the above configuration, the mobile terminal 500 can send information for controlling operations of the usage-side unit 220 and the indicator 400 according to the operation by the user 620. Thus, the mobile terminal 500 allows the user 620 to select the operation mode of the indicator 400, change the ID information of the usage-side unit 220, control the operation of the usage-side unit 220, and know the operation status of the usage-side unit 220. As a result, human interfaces of the indicator 400 can be simplified, and the user 620 can make the above operations without touching the indicator 400.

It is preferable that there are two types of the terminal control section 530. The first type is for a supervisory use and configured to send at least the mode information and the address information among the above information. The first type is for a private use and configured to send at least the operation information and the indication information among the above information. In this case, it is also preferable that the terminal control section 530 can be switched between these types only by authorized people or authorized devices.

<Operation of Unit Controller>

Figure 7:
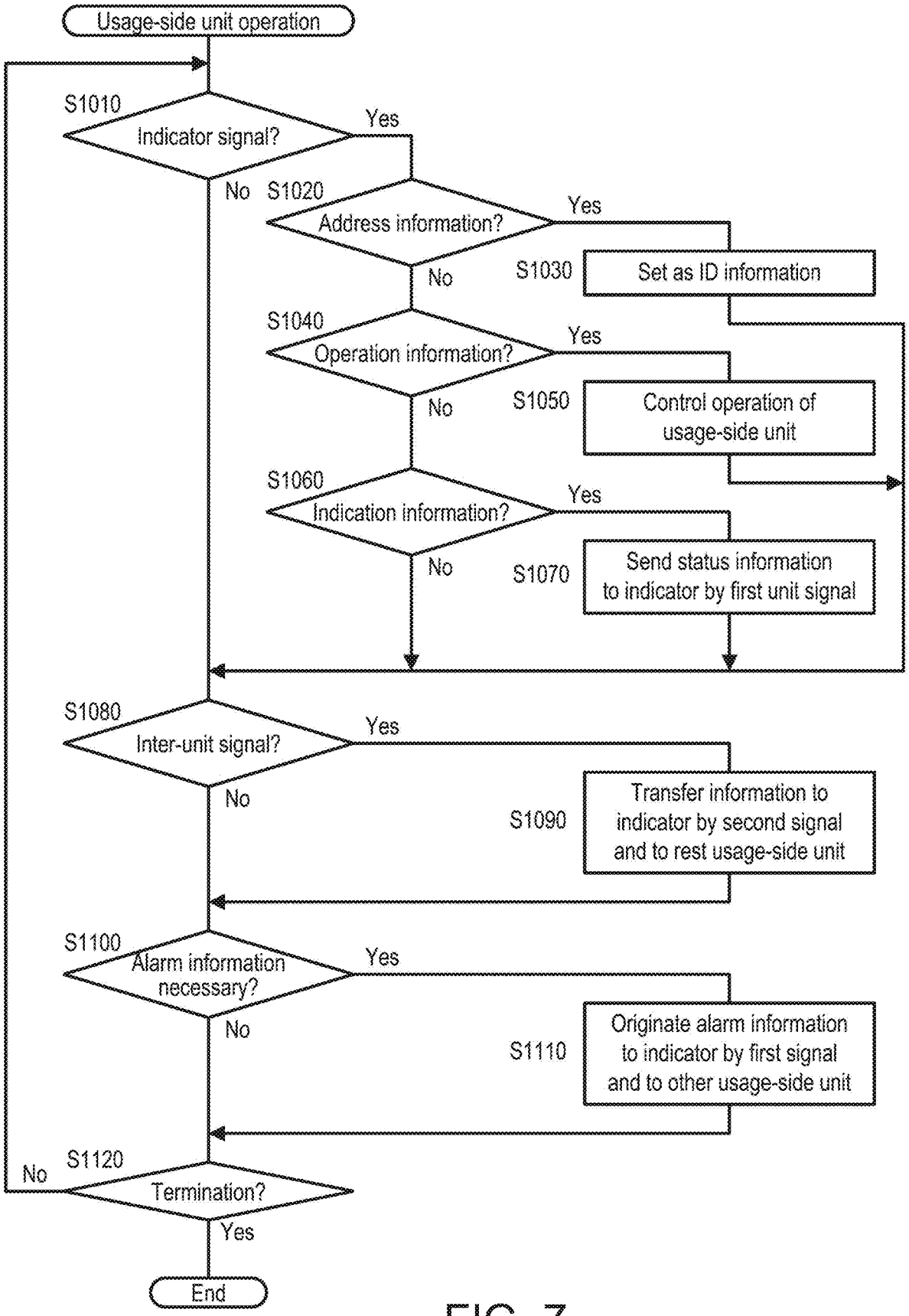
FIG. 7 is a flow chart indicating a process performed by a communication control section of the unit controller.

FIG. 7 is a flow chart indicating a process performed by the communication control section 370 of the unit controller 300.

In step S1010, the indicator signal processing section 371 determines whether an indicator signal has been received, if an indicator signal has been received (S1010: Yes), the indicator signal processing section 371 proceeds to step S1020, and if not (S1010: No), proceeds to later-mentioned step 1080.

In step S1020, the indicator signal processing section 371 determines whether the received indicator signal indicates address information. If address information is indicated (S1020: Yes), the indicator signal processing section 371 proceeds to step S1030, and if not (S1020: No), proceeds to later mentioned step 1040. In step 1030, the indicator signal processing section 371 sets the indicated address information as ID information of the usage-side unit 220.

In step S1040, the indicator signal processing section 371 determines whether the received indicator signal indicates operation information. If operation information is indicated (S1040: Yes), the indicator signal processing section 371 proceeds to step S1050, and if not (S1040: No), proceeds to later-mentioned step 1060. In step 1050, the indicator signal processing section 371 passes the indicated operation information to the operation control section 340 so as to control the usage-side unit 220 according to the operation information.

In step S1060, the indicator signal processing section 371 determines whether the received indicator signal indicates indication information. If indication information is indicated (S1060: Yes), the indicator signal processing section 371 proceeds to step S1070, and if not (S1060: No), proceeds to later-mentioned step 1080. Before proceeding to step 1080, the indicator signal processing section 371 may execute a certain process based on the received indicator signal. In step 1070, the indicator signal processing section 371 passes the indicated indication information to the information originating section 372 so as to originate status information of the usage-side unit 220 and send it to the indicator 400 by a first unit signal.

In step S1080, the inter-unit signal processing section 373 determines whether an inter-unit signal has been received. If an inter-unit signal has been received (S1080: Yes), the inter-unit signal processing section 373 proceeds to step S1090, and if not (S1080: No), proceeds to later-mentioned step 1100. In step S1090, the inter-unit signal processing section 373 transfers information indicated by the received inter-unit signal to the indicator 400 by means of a second unit signal. If there is the rest usage-side unit 220, the inter-unit signal processing section 373 transfers the same information to the rest usage-side unit 220 as well.

In step S1100, the information originating section 372 determines whether alarm information need to be outputted, e.g. whether an abnormality such as a refrigerant leakage has occurred in the usage-side unit 220. If alarm information need to be outputted (S1100: Yes), the information originating section 372 proceeds to step S1110, and if not (S1100: No), proceeds to later-mentioned step 1120. In step S1110, the information originating section 372 originates alarm information. In other words, the information originating section 372 sends alarm information including the ID information of the usage-side unit 220 to the indicator 400 by a first unit signal, and send the same information to the other unit controller 300 (the other usage-side unit 220).

The information originating section 372 may execute other process depending on the type of the occurred abnormality. For instance, when a refrigerant leakage has occurred, the information originating section 372 may control the operation control section 340 to shut off refrigerant valves (not shown) of the usage-side unit 220, output a flash or a buzzer from the usage-side unit 220, and/or send a request to the heat-source-side unit 210 to stop its operation.

In step S1120, the communication control section 370 determines whether a termination of operation has been designated. The designation may be made by a user operation, another device, or the communication control section 370 itself. If the termination of the operation has not been designated (S1120: No), the communication control section 370 proceeds back to step S1010, and if designated (S1120: Yes), terminates its operation.

By the above process, the usage-side unit 220 can properly and swiftly react to signal receptions and abnormality occurrences. It should be noted that the execution order of above-mentioned steps S1010 to S1070, steps S1080 and S1090, and steps S1100 and S1110 may be changed. The execution order of the execution order of steps S1020 and S1030, steps S1040 and S1050, and steps S1060 and S1070 may also be changed.

<Operation of Indicator>

Figure 8:
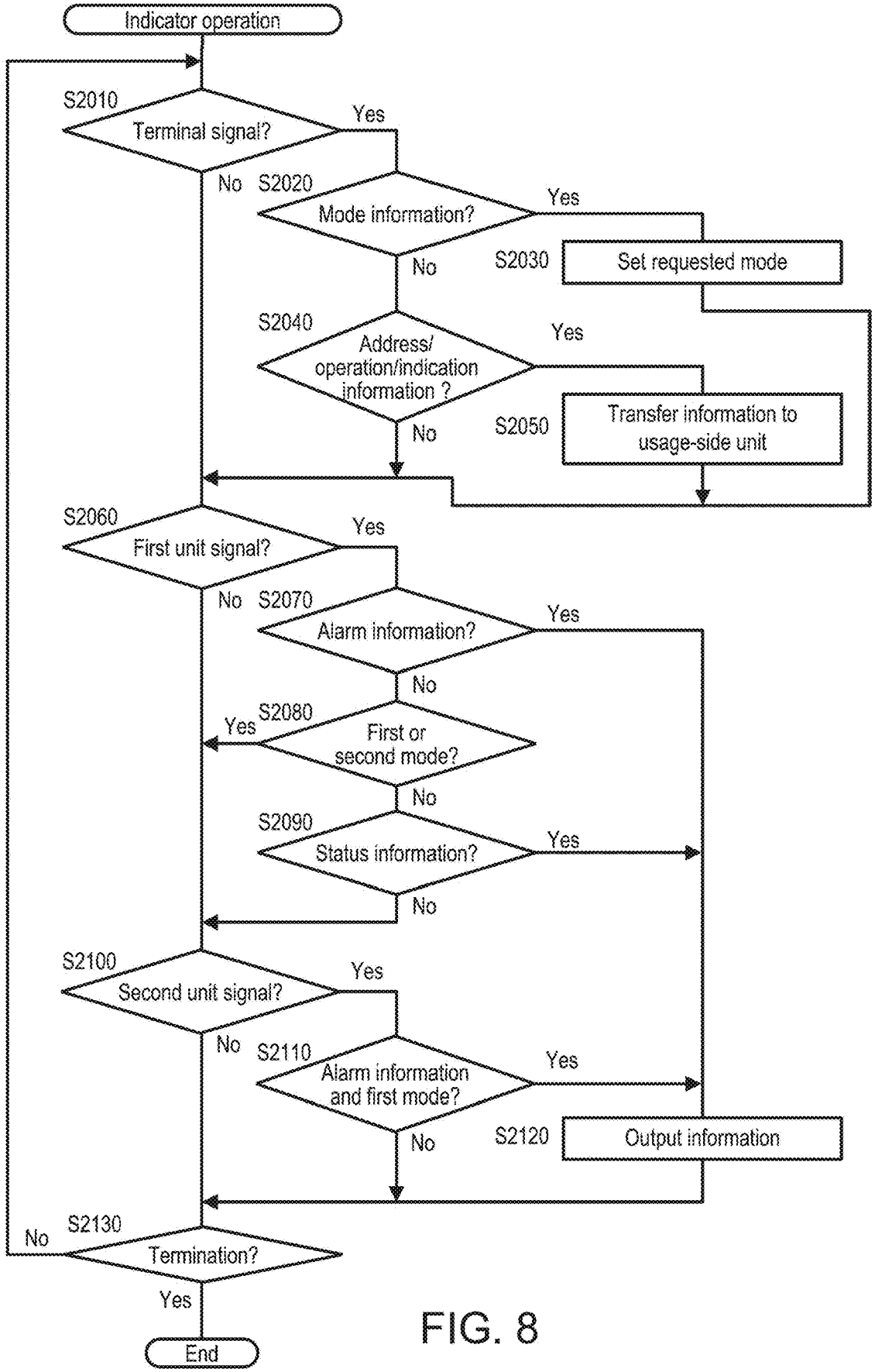
FIG. 8 is a flow chart indicating a process performed by an indicator control section of the indicator.

FIG. 8 is a flow chart indicating a process performed by the indicator control section 460 of the indicator 400.

In step S2010, the terminal signal processing section 461 determines whether a terminal signal has been received. If a terminal signal has been received (S2010: Yes), the terminal signal processing section 461 proceeds to step S2020, and if not (S2010: No), proceeds to later-mentioned step 2060.

In step S2020, the terminal signal processing section 461 determines whether the received terminal signal indicates mode information. If mode information is indicated (S2020: Yes), the terminal signal processing section 461 proceeds to step S2030, and if not (S2020: No), proceeds to later mentioned step 2040. In step 2030, the terminal signal processing section 461 passes the indicated mode information to the mode management section 462 so as to set the operation mode of the indicator 400 as requested by the mode information. In other words, the indicator 400 accepts, from the user 620, selection from the plurality of operation modes of the indicator 400.

In step S2040, the terminal signal processing section 461 determines whether the received terminal signal indicates one of address information, operation information, and indication information. If any one of them is indicated (S2040: Yes), the terminal signal processing section 461 proceeds to step S2050, and if not (S2040: No), proceeds to later-mentioned step 2060. Before proceeding to step 2060, the terminal signal processing section 461 may execute a certain process based on the received terminal signal. In step 2050, the terminal signal processing section 461 transfers the indicated information to the usage-side unit 220.

In step S2060, the unit signal processing section 463 determines whether a first unit signal has been received. If a first unit signal has been received (S2060: Yes), the unit signal processing section 463 proceeds to step S2070, and if not (S2060: No), proceeds to later-mentioned step 2100.

In step S2070, the unit signal processing section 463 determines whether the received first unit signal indicates alarm information. If alarm information is indicated (S2070: Yes), the unit signal processing section 463 proceeds to later-mentioned step S2120, and if not (S2070: No), proceeds to step 2080. In step 2080, the unit signal processing section 463 determines whether the indicator 400 is operating in any one of the first mode and the second mode. If the indicator 400 is operating in any one of the first mode and the second mode (S2080: Yes), the unit signal processing section 463 proceeds to later-mentioned step S2100, and if not (S2080: No), proceeds to step S2090.

In step 2090, the unit signal processing section 463 determines whether the received first unit signal indicates status information. If status information is indicted (S2090: Yes), the unit signal processing section 463 proceeds to later-mentioned step S2120, and if not (S2080: No), proceeds to step S2100. Before proceeding to step 2120, the unit signal processing section 463 may execute a certain process based on the received first unit signal.

In step S2100, the unit signal processing section 463 determines whether a second unit signal has been received. If a second unit signal has been received (S2100: Yes), the unit signal processing section 463 proceeds to step S2110, and if not (S2100: No), proceeds to later-mentioned step 2130.

In step S2110, the unit signal processing section 463 determines whether the received second unit signal indicates alarm information and the indicator 400 is operating in the first mode. If alarm information is indicated and the indicator 400 is operating in the first mode (S2110: Yes), the unit signal processing section 463 proceeds to step S2120, and if not (S2110: No), proceeds to later mentioned step S2130. Before proceeding to step 2130, the unit signal processing section 463 may execute a certain process based on the received second unit signal.

In step S2120, the unit signal processing section 463 passes the indicated information to the indicator output section 440 so as to output the information from the indicator 400. In other words, when alarm information has been received or acquired by means of a first unit signal, when a first unit signal indicating status information has been received or acquired during the indicator 400 is operating in the third mode, and when alarm information has been received or acquired by means of a second unit signal during the indicator 400 is operating in the first mode, the indicator 400 outputs the information.

In step S2130, the indicator control section 460 determines whether a termination of operation has been designated. The designation may be made by a user operation, another device, or the indicator control section 460 itself. If the termination of the operation has not been designated (S2130: No), the indicator control section 460 proceeds back to step S2010, and if designated (S2130: Yes), terminates its operation.

By the above process, the indicator 400 can properly and swiftly react to signal receptions, in particular, properly regulate its information output. It should be noted that the execution order of above-mentioned steps S2010 to S2050, steps S2060 to S2090, and steps S2100 and S2110 may be changed. Moreover, the execution order of the above-mentioned steps S2020 and S2030, and steps S2040 and S2050 may also be changed.

<Operation of Mobile Terminal>

The terminal control section 530 of the mobile terminal 500 repeatedly determines whether the requests on the heat-pump system 100 mentioned above has been inputted by the user 620, and transmits, when the request has been inputted, the corresponding information to the indicator 400, including mode information, address information, operation information, and indication information. Thereby, the mobile terminal 500 can properly and swiftly make a request according to intentions of the user 620, in particular, properly select the operation mode of each indicator 400 and set ID information to each usage-side unit 220.

<Operation of System>

Figure 9:
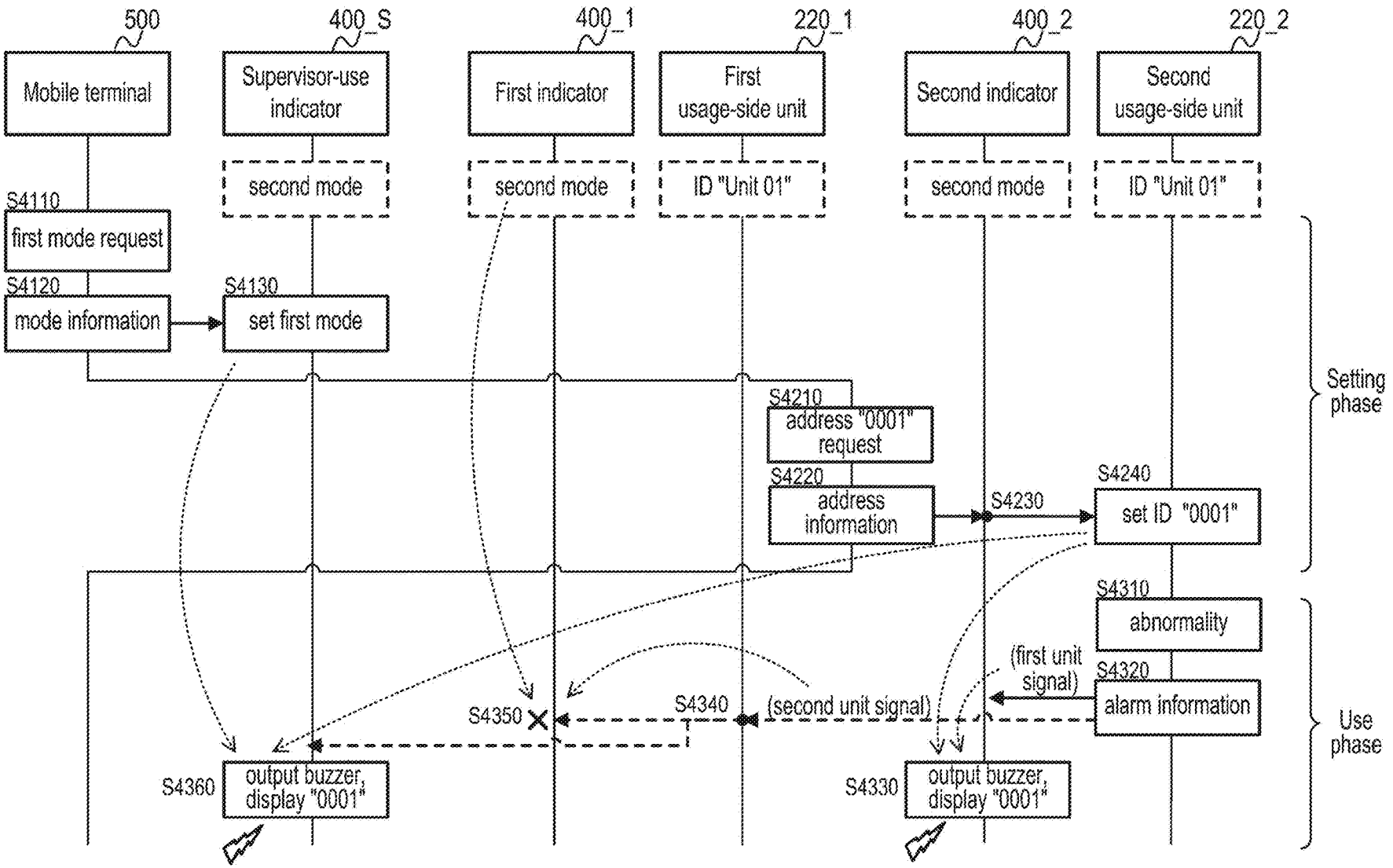
FIG. 9 is a sequential diagram indicating an example of an operation the heat-pump system.

FIG. 9 is a sequential diagram indicating an example of an operation the heat-pump system 100.

As shown in FIG. 9, the second mode is set to the indicators 400_S, 400_1, 400_2 and ID information "0001" is set to the usage-side units 220_1, 200_2 for instance. When a request of setting the first mode is made in the mobile terminal 500 when it is in the vicinity of the supervisor-use indicator 400_S (S4110), the mobile terminal 500 send mode information indicating the first mode to the supervisor-use indicator 400_S (S4120). As a result, the supervisor-use indicator 400_S sets the first mode to itself (S4130).

Then, when the mobile terminal 500 is brought to the vicinity of the second indicator 400_2 and a request of setting an address "0001" is made in the mobile terminal 500 (S4210), the mobile terminal 500 sends address information indicating the address "0001" to the second indicator 400_2 (S4220). The second indicator 400_2 (S4220) transfers this address information to the second usage-side unit 220_2

(S4230), and the second usage-side unit 220_2 sets the address "0001" as its new ID information (S4240). These steps S4110 to S4240 belong to a setting phase of the heat-pump system 100 for achieving appropriate information output.

After the above setting phase, if an abnormality has occurred in the second usage-side unit 220_2 (S4310), the second usage-side unit 220_2 originates alarm information and send it to the second indicator 400_2 by a first unit signal, and to the first usage-side unit 220_1 by an inter-unit signal (S4320). As a result, the second indicator 400_2 outputs a buzzer and displays the text "0001" (S4320), because the alarm information has been indicated by a first unit signal.

The first usage-side unit 220_1 transfers the alai in information to the first indicator 400_1 and the supervisor-use indicator 400_S by second unit signals (S4340). However, the first indicator 400_1 does not output a buzzer nor display the text "0001" (S4350), because the alarm information has been indicated by a second unit signal and the first indicator 400_1 is operating in the second mode. Meanwhile, the supervisor-use indicator 400_S outputs a buzzer and displays the text "0001" (S4360), because the supervisor-use indicator 400_S is operating in the first mode. These steps S4310 to S4360 belong to a use phase the heat-pump system 100 for outputting information when necessary.

Accordingly, the indicator 400 can behave in different ways to output information depending on which operation mode is set and whether the information has been originated by the connecting usage-side unit 220.

FIGS. 10A to 10D are plan views of the indicator 400 showing examples of a display state thereof.

Figure 10A:
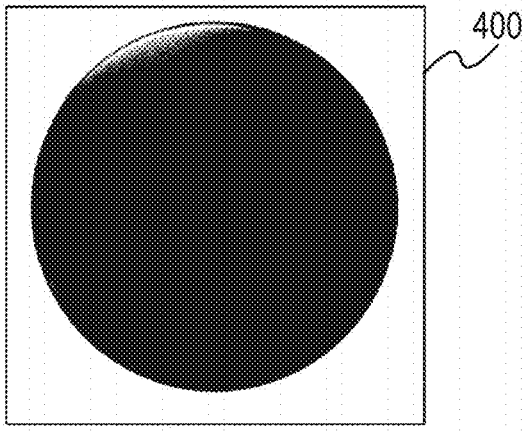
FIGS. 10A to 10F are plan views of the indicator showing examples of a display state thereof.
Figure 10B:
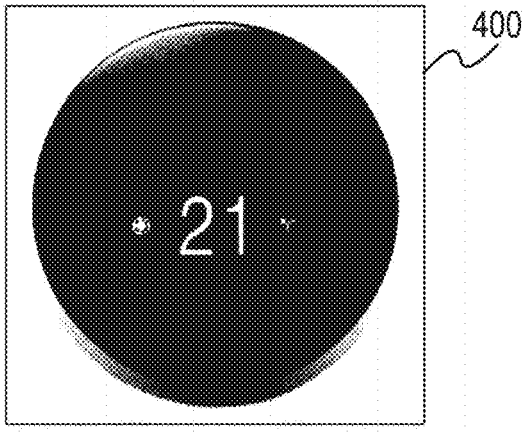
Figure 10C:
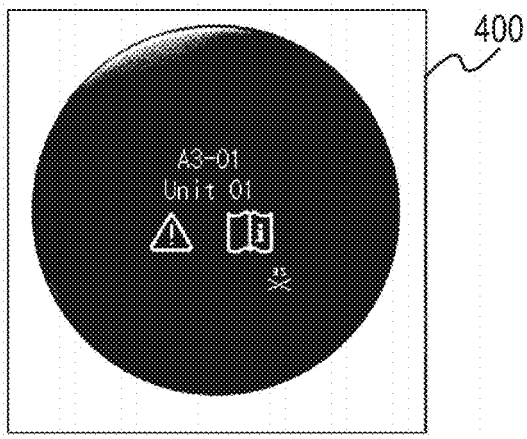
Figure 10D:
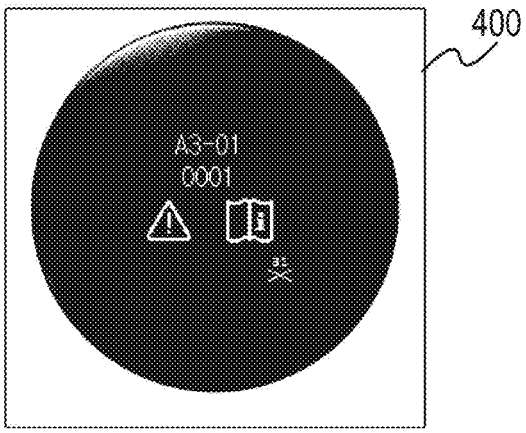

When the indicator 400 is not operating or has not received any information, it displays no information as shown in FIG. 10A. When the indicator 400 has received status information such as a target temperature by a first unit signal, it displays the received information as shown in FIG. 10B. When the indicator 400 operating in the first mode has received alarm information, it displays the received information as shown in FIG. 10C if the originating usage-side unit 220 maintains the ID information as initially set. On the other hand, if the originating usage-side unit 220 has changed its ID information based on the address information, the new ID information is displayed as shown in FIG. 10D.

Hence, the ID information to be displayed in the indicators 400 can be changed as desired by the user 620. This helps the user 620 as a monitoring person of the heat-pump system 100 to grasp the relationship between the displayed alarm information and the usage-side unit 220 which is the origin of the alarm information. For instance, it is allowed to the user 620 to swiftly know in which usage-side unit 220 an abnormality has occurred.

Figure 10E:
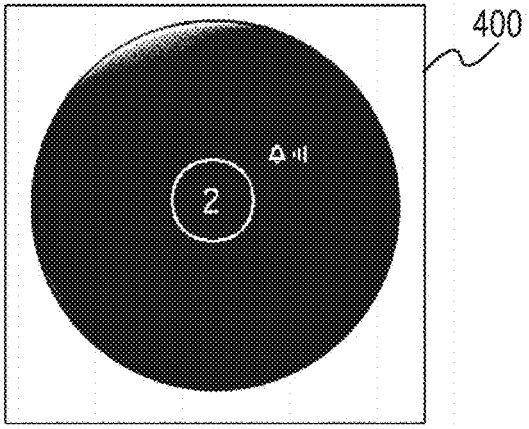
Figure 10F:
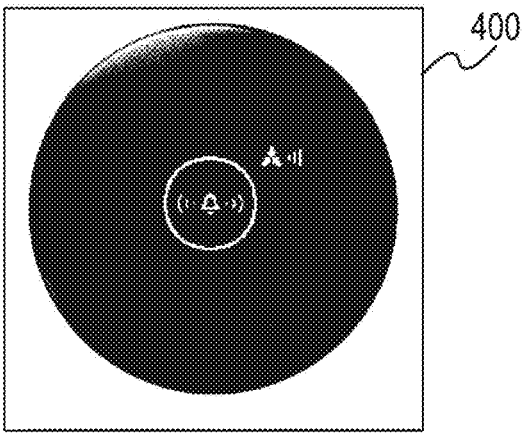

It should be noted that a plurality of the usage-side units 220 may form a unit group in which the usage-side units 220 operate in the same manner or cooperating manner. In such a unit group, a plurality of the indicators 400 may include a main usage-side unit 220 which represents the unit group to originate alarm information towards the outside of the unit group and transfer alarm information from the outside of the unit group. In this case, the ID information change may be necessary for only the main usage-side unit 220. In general, the usage-side units 220 initially have sequential serial numbers within the unit group as their ID information. Thus, the indicator 400 connected to the usage-side unit 220 other than the main usage-side unit 220 may display such initial ID information as shown in FIG. 10E, while the supervisor-use indicator 400_S displays the new ID information of the main usage-side unit 220 as shown in FIG. 10D. When this indicator 400 is activated in the first mode, it may display an alarm mark as shown in FIG. 10F.

<Advantageous Effect>

According to the heat-pump system 100, it is possible to output alarm information originated by one of the usage-side units 220 from only the indicator 400 directly connecting to the usage-side units 220 which originated the alarm information and the other arbitrarily selected indicator 400. Moreover, such a regulated information output can be achieved without providing any information output device having a different configuration from the indicators 400. Hence, the manageability and usability of the refrigerant system 100 can be improved at a low cost.

<Modifications>

The abnormalities which trigger alarm information are not limited to the above-mentioned abnormalities. For instance, abnormalities in the heat-source-side unit 210 may also trigger origination of alarm information. Such abnormalities may include a case where discharge temperature of a refrigerant compressor (not shown) of the heat-source-side unit 210 has exceeded a predetermined value, a case where rotational speed of the refrigerant compressor has exceeded a predetermined value, or the like. In this case, any one of the heat-source-side unit 210 and the usage-side units 220 may detect occurrence of the abnormality to originate alarm information. In any case, the originating unit should originate alarm information indicating the heat-source-side unit 210 as a location of the abnormality has occurred. The indicator 400 outputs the alarm information to indicate that an abnormality has occurred in the heat-source-side unit 210. It is preferable that only the indicator 400 which is operating in the first mode outputs such alarm information.

While only selected embodiments have been chosen to illustrate the present invention, it will be apparent to those skilled in the art from this disclosure that various changes and modifications can be made herein without departing from the scope of the invention as defined in the appended claims. For example, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Thus, the foregoing descriptions of the embodiments according to the present invention are provided for illustration only.

REFERENCE SIGNS LIST

100: Heat-Pump System
210: Heat-Source-Side Unit
220: Usage-Side Unit
221: Leakage Sensor
231, 232, 233, 234: Communication Path
300: Unit Controller
310: System-Side Communication Section
320: Indicator-Side Communication Section

330: Inter-Unit Communication Section
340: Operation Control Section
350: Abnormality Detection Section
360: Unit Storage Section
370: Communication Control Section
371: Indicator Signal Processing Section
372: Information Originating Section
373: Inter-Unit Signal Processing Section
400: Indicator
401: Casing
402: On/Off Button
403: Display Panel
404: Display Area
405: Operation Area
406: Loudspeaker
407: LED
410: Terminal-Side Communication Section
420: Unit-Side Communication Section
430: Indicator Input Section
440: Indicator Output Section
450: Indicator Storage Section
460: Indicator Control Section
461: Terminal Signal Processing Section
462: Mode Management Section
463: Unit Signal Processing Section
464: Schematic Table
500: Mobile Terminal
510: Terminal Communication Section
520: Terminal Input Section
530: Terminal Control Section
611: Target Area
612: Monitoring Room
620: User

The invention claimed is:

1. An indicator for outputting information relating to a heat-pump system including a plurality of usage-side units which form a communication network, the indicator comprising:

a mode management section configured to accept selection from a plurality of operation modes of the indicator including a first mode;

a unit-side communication section configured to receive or acquire a first unit signal and a second unit signal from a predetermined usage-side unit of the usage-side units, the first unit signal being used for information originated by the predetermined usage-side unit, and the second unit signal being used for information not originated by the predetermined usage-side unit; and an indicator output section configured to, when alarm information has been received or acquired via the second unit signal while the indicator is operating in a first mode, output the alarm information; and a unit signal processing section configured to, when information has been received or acquired via the second unit signal while the indicator is not operating in the first mode, restrain the information from being outputted by the indicator output section.

2. The indicator according to claim 1, wherein the indicator output section is further configured to, when alarm information has been received or acquired via a first unit signal, output the alarm information.

3. The indicator according to claim 1, wherein the unit signal processing section is further configured to, when non-alarm information has been received or acquired via any of first and second signals while the indicator is operating in the first mode, restrain the non-alarm information from being outputted by the indicator output section.

4. The indicator according to claim 1, wherein the plurality of operation modes includes a second mode, and the unit signal processing section is further configured to, when non-alarm information has been received or acquired via a first unit signal while the indicator is operating in the second mode, restrain the non-alarm information from being outputted by the indicator output section.

5. The indicator according to claim 1, further comprising:

a terminal-side communication section configured to receive terminal signals from a mobile terminal via wireless communication, the mode management section being configured to, when a request on the selection from the operation modes has been received via a terminal signal, accept the request.

6. The indicator according to claim 5, wherein the unit-side communication section is further configured to transmit indicator signals to the predetermined usage-side unit and, when address information set as identification information of the predetermined usage-side unit has been received via a terminal signal, transfer the address information to the predetermined usage-side unit via an indicator signal.

7. The indicator according to claim 1, wherein the alarm information includes identification information of the usage-side unit in which an abnormality has occurred.

8. The indicator according to claim 7, wherein the abnormality includes a refrigerant leakage.

9. The indicator according to claim 2, further comprising:

a terminal-side communication section configured to receive terminal signals from a mobile terminal via wireless communication, the mode management section being configured to, when a request on the selection from the operation modes has been received via a terminal signal, accept the request.

10. The indicator according to claim 2, wherein the alarm information includes identification information of the usage-side unit in which an abnormality has occurred.

* * * * *